US008198997B2

(12) United States Patent
Bennett et al.

(10) Patent No.: US 8,198,997 B2
(45) Date of Patent: Jun. 12, 2012

(54) FIRE GAS DETECTOR-CODING

(75) Inventors: Steven Ian Bennett, Middlesex (GB); Don Brighenti, Westminster, MA (US); Joe Piccolo, Fitzwilliam, NH (US); Kimberly Babineau, Greenfield, MA (US)

(73) Assignees: SimplexGrinnell LP, Westminster, MA (US); Thorn Security Limited, Sunbury-on-Thames, Middlesex (GB)

( * ) Notice: Subject to any disclaimer, the term of this patent is extended or adjusted under 35 U.S.C. 154(b) by 495 days.

(21) Appl. No.: 12/568,423

(22) Filed: Sep. 28, 2009

(65) Prior Publication Data

US 2010/0026480 A1 Feb. 4, 2010

Related U.S. Application Data

(63) Continuation of application No. PCT/GB2008/000876, filed on Mar. 13, 2008, and a continuation-in-part of application No. 11/587,461, filed on Oct. 25, 2006, now Pat. No. 7,609,154.

(30) Foreign Application Priority Data

Apr. 30, 2004 (GB) ..... 0409759.8
Mar. 27, 2007 (GB) ..... 0705888.6

(51) Int. Cl.
*G08B 29/00* (2006.01)

(52) U.S. Cl. ..... 340/514

(58) Field of Classification Search ..... 340/514, 340/628, 632, 635, 619; 324/500
See application file for complete search history.

(56) References Cited

U.S. PATENT DOCUMENTS

| | | | | |
|---|---|---|---|---|
| 5,646,598 | A * | 7/1997 | Nickles et al. | 340/628 |
| 7,205,901 | B2 * | 4/2007 | Demster | 340/636.1 |
| 8,054,188 | B2 * | 11/2011 | Harkins et al. | 340/632 |
| 2007/0069904 | A1 * | 3/2007 | DeLuca et al. | 340/628 |
| 2009/0154299 | A1 * | 6/2009 | Solhjoo et al. | 368/108 |

* cited by examiner

*Primary Examiner* — Phung Nguyen
(74) *Attorney, Agent, or Firm* — Brinks, Hofer, Gilson & Lione

(57) ABSTRACT

A detector comprises a detector base and a sensor, first and second resistors connected in series, a DC voltage source (Vref) connected to the resistors, and means for monitoring the voltage at the midpoint of a potential divider constituted by the series-connected resistors. The first and second resistors are rated so that the midpoint voltage is indicative of the date of manufacture of the sensor.

18 Claims, 1 Drawing Sheet

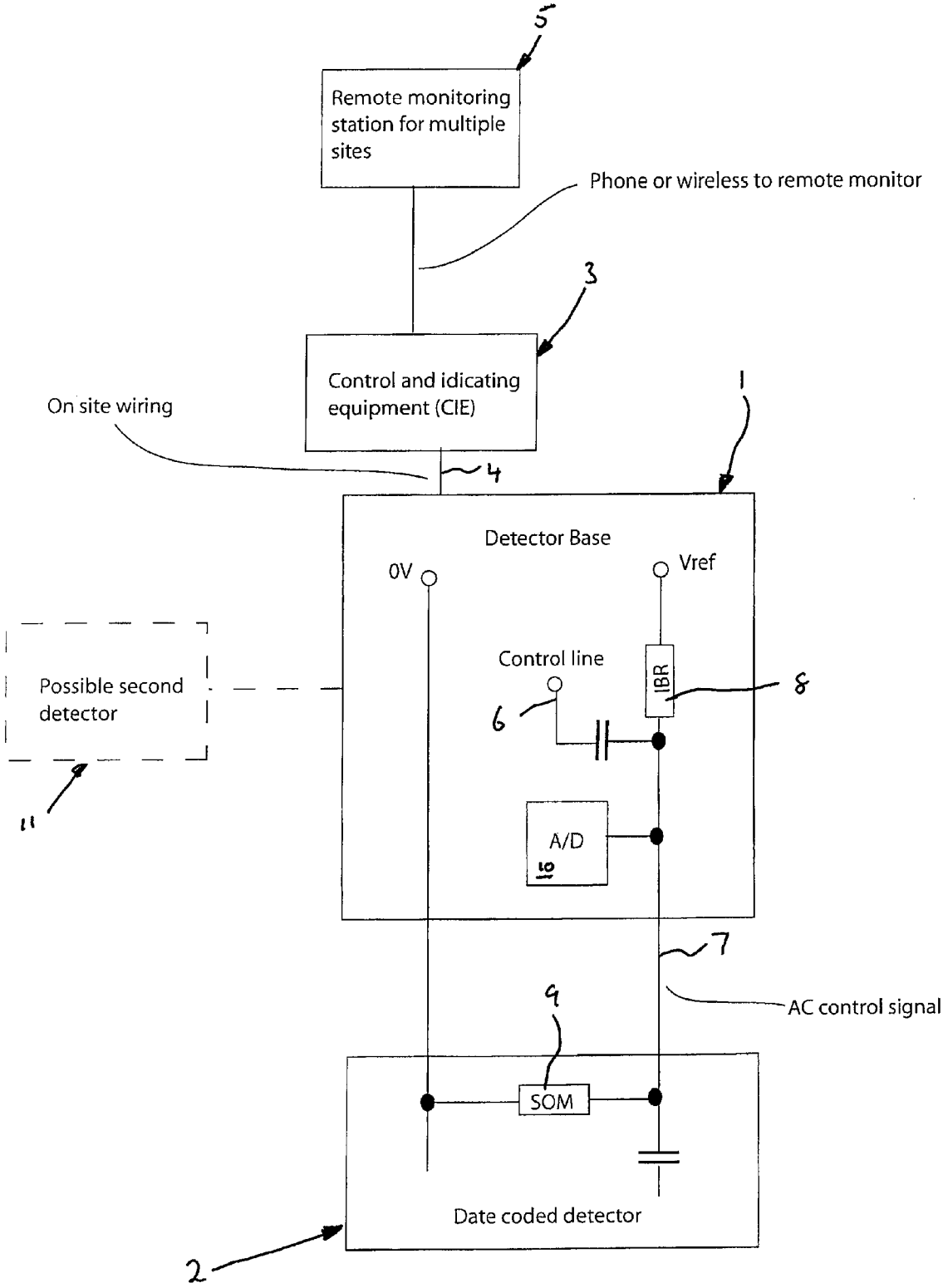
5
Remote monitoring station for multiple sites
Phone or wireless to remote monitor
3
Control and idicating equipment (CIE)
On site wiring
1
4
Detector Base
0V
Vref
Control line
IBR
8
6
Possible second detector
11
A/D
10
7
AC control signal
9
SOM
Date coded detector
2

FIRE GAS DETECTOR-CODING

CROSS-REFERENCE TO RELATED APPLICATIONS

This application claims priority to PCT Application No. PCT/GB2008/000876 filed on Mar. 13, 2008 (published as WO 2008/117016 A1), titled "Detector"; which claims priority to United Kingdom Application No. 0705888.6 filed on Mar. 27, 2007 (published as GB 2 447 917 A), titled "Detector"; and is a continuation-in-part of U.S. application Ser. No. 11/587,461 filed on Oct. 25, 2006 (published as U.S. Patent Application No. 2007/0216527), titled "Testing a Fire Detector Sensor"; which is a national phase application of PCT Application No. PCT/GB2005/001641 filed on Apr. 29, 2005 (published as WO 2005/106822 A1), titled "Testing a Fire Detector Sensor"; which claims priority to United Kingdom Application No. 0409759.8 filed on Apr. 30, 2004 (published as GB 2 413 635 A), titled "Testing a Fire Detector Sensor". U.S. application Ser. No. 11/587,461 (published as U.S. Patent Application No. 2007/0216527), PCT Application No. PCT/GB2005/001641 (published as WO 2005/106822 A1), GB Application No. 0409759.8 (published as GB 2 413 635 A), PCT Application No. PCT/GB2008/000876 (published as WO 2008/117016 A1), and GB Application No. 0705888.6 (published as GB 2 447 917 A) are each hereby incorporated by reference for all purposes in their entirety.

BACKGROUND OF THE INVENTION

This invention relates to a detector, and in particular to a fire detector.

A fire detector typically includes one or more sensing elements, such as an optical smoke sensing element, a CO sensor for detecting carbon monoxide, or a pyroelectric sensor for detecting the presence of a flame. The problem with known fire detectors is that each type of sensing element tends to decay with time, without there being provided means for accurately establishing exactly how much the sensitivity of its sensing element has changed since installation. This problem is exacerbated where a fire detector is provided with two or more different types of sensor (for example an optical smoke detecting sensor and a CO sensor), which tend to decay at different rates, requiring more frequent manual inspection which is time consuming and expensive.

This problem can be overcome in cases where a fire detector sensor is associated with an EEPROM, in which case a manufacturing date code is entered into the EEPROM. This manufacturing date code can then be interrogated by control and indicating equipment (CIE) which is provided to monitor and control the fire detector. For cost reasons, however, many fire detectors do not have EEPROMs associated with their sensors. Throughout this specification, the term "date code" should be taken to mean a code representation of the period of time during which a particular sensor was manufactured. Typically, this period of time will be six months or one year.

SUMMARY OF THE INVENTION

The present disclosure defined by the following claims, and nothing in this section should be taken as a limitation on those claims.

An aim of the invention is to provide a fire detector that can provide a date code to a CIE at minimum cost.

The present invention provides a detector comprising a detector base and a sensor, first and second resistors connected in series, a DC voltage source connected to the resistors, and means for monitoring the voltage at the midpoint of a potential divider constituted by the series-connected resistors, wherein the first and second resistors are rated so that the midpoint voltage is indicative of a property of the sensor. The detector may further comprise a second sensor provided on the detector base, the second sensor having a third resistor, the first and third resistors being connected in series, the DC voltage source being connected to the first and third resistors, and the second sensor being provided with means for monitoring the voltage at the midpoint of a potential divider constituted by the series-connected first and third resistors, wherein the first and third resistors are rated so that the midpoint voltage is indicative of a property of the second sensor Preferably, the first resistor is provided on the detector base, and the second resistor is associated with the sensor.

Advantageously, the sensor is a separate item from the detector base, the second resistor being combined with the sensor.

Conveniently, the monitoring means and the voltage source are provided on the detector base.

Preferably, the monitoring means is constituted by an A/D converter.

Advantageously, the detector base is provided with an AC control line for controlling a self-test of the sensor, the DC voltage from the DC voltage source being superimposed on the AC line.

In a preferred embodiment, the sensor is a CO sensor for fire detection.

Preferably, the sensor property is the date code of the sensor.

In another preferred embodiment, the detector further comprises a second sensor, the second sensor having a third resistor, the first and third resistors being connected in series, the DC voltage source being connected to the first and third resistors, and the second sensor being provided with means for monitoring the voltage at the midpoint of a potential divider constituted by the series-connected first and third resistors, wherein the first and third resistors are rated so that the midpoint voltage is indicative of a property of the second sensor.

Advantageously, the monitoring means of the second sensor is constituted by an A/D converter.

Preferably, the second sensor is a separate item from the detector base, the third resistor being combined with the second sensor. Alternatively, the second sensor is provided on the detector base. In either case, the property of the second sensor may be the date code of that sensor.

The invention also provides a detector system comprising a central control and a plurality of detectors as defined above.

Preferably, the central control is provided with software for interrogating each of the detectors to request the monitoring means of each detector to return to the central control a signal indicative of said property of the sensor of that detector.

The invention further provides a detector arrangement comprising a plurality of detector systems as defined above, and a monitoring station provided with means for communicating with the central control of each of the detector systems.

Each of the embodiments described herein can be used alone or in combination with one another. The embodiments will now be described with reference to the attached drawings.

BRIEF DESCRIPTION OF THE DRAWING

The invention will now be described in greater detail, by way of example, with reference to the drawing, single FIG- URE of which is a schematic circuit diagram of a detector constructed in accordance with the invention.

DETAILED DESCRIPTION

The disclosure can be better understood with reference to the following drawing and description. The components in the FIGURE are not necessarily to scale, emphasis instead being placed upon illustrating the principles of the present disclosure. Moreover, in the FIGURE, like referenced numerals designate corresponding parts or elements throughout the different views.

Referring to the drawing, a fire detector is constituted by a detector base 1 and a sensor 2. The detector base is attached to a software-controlled CIE 3 by on-site wiring 4. The CIE 3 is connectable wirelessly to a remote monitoring station 5. The CIE 3 is associated with a plurality of other fire detectors (not shown), thereby constituting a central control for all the fire detectors.

The detector base 1 is provided with a control line 6 which is used to send a signal, via an AC control line 7, to the sensor 2 for carrying out a self-test of that sensor.

The detector base 1 is provided with an internal base resistor (IBR) 8, and the sensor 2 is provided with a select on manufacture (SOM) resistor 9. An analogue-to-digital (A/D) converter 10 is provided in the detector base 1 for monitoring the midpoint voltage between the potential divider constituted by the two resistors 8 and 9. The detector base 1 is provided with a DC voltage reference Vref, which is typically 5 volts. The DC voltage reference Vref is applied to both the A/D converter 10 and the potential divider, so that an extra Vref line running to the sensor 2 is not required. This ensures that the only source of inaccuracy is the potential divider resistance tolerance (<1%±a 1 bit digitising error).

The resistors 8 and 9 can have values in the range from several kilohms to tens of megohms. The IBR resistor 8 has a fixed value, which is common to all detector bases used in a fire detector system. The value of the resistor 8 is chosen such that it is high enough to eliminate excessive currents when the SOM resistor 9 has a low value, but low enough such that the SOM resistor does not go beyond the usual range of resistor values whilst allowing the network to yield a wide dynamic range for the midpoint voltage. Each of the SOM resistors 9 in the system has a value which is chosen in dependence upon the date of manufacture of the associated sensor 2. Thus, the rating of the SOM resistor 9 of a given sensor 2 is chosen so that the midpoint voltage of the potential divider constituted by that resistor and the IBR resistor 8 of the associated detector base 1 represents the date code of that sensor. As previously mentioned, the period of time covered by each date code may be six months, and each sensor 2 manufactured in that period will be provided with a SOM resistor 9 of the same value, and each sensor manufactured in any other six month period will be provided with a SOM resistor of a different value. Thus, the midpoint voltage monitored by the A/D converter 10 of a given detector base 1 will provide an indication of the period in which the associated sensor 2 was manufactured. Moreover, as the AC control line 7 forms part of the potential divider, the hardware interconnections for generating the date code are minimized.

In use, the CIE 3 remotely interrogates each of the detectors in its system. The A/D converter 10 of each detector then responds with a digital signal corresponding to the analogue midpoint value of the associated potential divider, thereby informing the CIE 3 of the period in which the associated sensor 2 was manufactured. The CIE 3 will then calculate the time difference between the sensed manufacturing period and the interrogation date, and will inform an operator that maintenance is required if this difference exceeds a predetermined service interval. The operator will then be able to visit each detector which requires maintenance for replacement of the sensor 2 of that detector.

Alternatively, the CIE 3 would be programmed with regular maintenance intervals, and would provide an operator with an advance warning of all the sensors 2 in the system which are about to reach a "service required" interval.

Where the fire detector system forms part of a larger fire detector arrangement in which the remote monitoring station 5 has overall control for a plurality of fire detector systems of this type, the CIEs 3 are arranged to output operator alert signals to the remote monitoring station which, in turn, signals an appropriate operator for each of the systems under its control. In practice, the remote monitoring station 5 is connected to the CIE 3 only when monitoring is to be carried out, say one every six months or once every year.

The detector 1 may be a CO sensor which typically has a more rapid decay time than other sensors (such as an optical smoke detecting sensor or a pyroelectric sensor) for use in fire detection. With such an arrangement, it is particularly important that regular maintenance is carried out, so that improved reliability of a fire detector system results.

The invention is particularly useful where the fire detectors of a fire detection system are each provided with two different types of sensor, typically a CO sensor and an optical smoke detecting sensor. Thus, as an optical smoke detecting sensor decays much more slowly than a CO sensor, maintenance of smoke detectors needs to be carried out substantially less frequently, so maintenance regimes which are typically arranged to monitor smoke detectors are liable not to provide good maintenance for CO sensors.

As shown in the drawing, a second sensor 11, such as an optical smoke detecting sensor or a pyroelectric sensor, may be associated with the detector base 1. This sensor 11 will also be provided with a SOM resistor which can be linked to an IBR. An A/D converter will monitor the midpoint of the two resistors constituting the potential divider of the second sensor 11, in a similar manner to that described above. The SOM resistor and the IBR resistor associated with the second sensor 11 are separate items from the SOM resistor 9 and the IBR resistor 8 of the sensor 2. Or, the SOM resistor associated with the second sensor 11 may be the same as the SOM resistor 9 of the sensor 2. The A/D converter of the second sensor 11 can be a separate item, but could also be constituted by the same A/D converter 10 with, for example, appropriate signal switching. Thus, the CIE 3 will be provided with signals representative of the date code of each of the two sensors 2 and 11, so that an operator can be dispatched to maintain either of the sensors of any of the fire detectors in the system at an appropriate time.

In a modified arrangement, the second sensor 11 could be provided on the detector base 1.

An important advantage of the type of fire detector described above is that the sensor 2 is a separate item from the detector base 1, and includes only the minimum amount (its SOM resistor and an associated calibration circuit element) hardware in addition to that required for actual sensing. Consequently, when the sensor 2 requires replacement, the cost of this is minimized. This is due to the date code (the period during which the sensor 2 was manufactured) being coded by the voltage derived from the potential divider, part of which is found in the replaceable sensor 2, and part in the detector base 1.

Other advantages are that an accurate voltage reference for the potential divider is provided from the same source as that used for providing the A/D voltage reference, that the voltage representing the date code is superimposed as a DC voltage on an AC line, thereby minimising interconnections between the replaceable sensor 2 and the detector base 1, that remote interrogation of the detector base to indicate "end of lifetime" is done by the CIE 3, thereby eliminating the need for an operator to visit all the detectors in a fire detector system, and that predictive software, linked in with regular service intervals, is employed, so that "service required" warning signals are raised together during each service visit.

A fire detector system incorporating fire detectors of this type provides additional features to assist service personnel in monitoring and servicing the fire detectors of the system. Thus, the system can produce a service report which includes the date code of each of the fire detectors. It also provides means for a service engineer to read the date codes of the fire detectors in a given system from the control panel of that system when the service engineer visits. In either case, the service engineer has the option of replacing sensors that will expire soon, so that he is not called back in the near future for a further service visit.

It will be apparent that the invention could be adapted to cover information coding other than the date code (the period during which a sensor was manufactured). For example, if a sensor has to achieve a multiplicity of approvals, for sale in various different geographical areas, area codings could be provided in the same way as the date codes, to ensure that sensors sold into a given geographical area are the correct approved types for that area. This can be done in conjunction with the date code, if the change of period coding is made to coincide with the manufacturing period of a variant with a particular approval. Information coding could also cover other possibilities, such as model, type or version of sensors. It would also be possible to replace each SOM resistor 9 by two resistors in series, thereby allowing fine tuning of the network values for additional steps.

Rather than having a fixed value, the IBR resistor 8 could be replaced by a potentiometer, a resistor array with a DIP switch, or a breakable fuse array permitting selection of a combination of resistors.

In a further modification, monitoring of each of the detectors in a fire detection system can be carried out by a hand-held device. In this case, the arrangement can be such that each of the detectors returns, to the CIE 3 and/or the hand-held device, a signal indicative of the date code of that detector.

It is intended that the foregoing detailed description be understood as an illustration of selected forms that the present disclosure can take and not as a definition of the present disclosure. It is only the following claims, including all equivalents, that are intended to define the scope of this present disclosure.

The invention claimed is:

1. A detector comprising:
a detector base;
a sensor;
first and second resistors connected in series;
a DC voltage source connected to the resistors; and
monitoring circuit for monitoring voltage at a midpoint of a potential divider constituted by the series-connected resistors,
wherein the first and second resistors are rated so that the midpoint voltage is indicative of a property of the sensor.

2. The detector as claimed in claim 1, wherein the first resistor is provided on the detector base, and the second resistor is associated with the sensor.

3. The detector as claimed in claim 2, wherein the sensor is a separate item from the detector base, the second resistor being combined with the sensor.

4. The detector as claimed in claim 2, further comprising a second sensor, the second sensor having a third resistor, the first and third resistors being connected in series, the DC voltage source being connected to the first and third resistors, and the second sensor being provided with a second monitoring circuit for monitoring the voltage at the midpoint of a potential divider constituted by the series-connected first and third resistors, wherein the first and third resistors are rated so that the midpoint voltage is indicative of a property of the second sensor.

5. The detector as claimed in claim 4, wherein the second monitoring circuit of the second sensor comprises an A/D converter.

6. The detector as claimed in claim 4, wherein the second sensor is a separate item from the detector base, the third resistor being combined with the second sensor.

7. The detector as claimed in claim 4, wherein the second sensor is provided on the detector base.

8. The detector as claimed in claim 4, wherein the property of the second sensor is a date code of that sensor.

9. The detector as claimed in claim 1, wherein the monitoring circuit and the voltage source are provided on the detector base.

10. The detector as claimed in claim 1, wherein the monitoring circuit further comprises an A/D converter.

11. The detector as claimed in claim 1, wherein the detector base is provided with an AC control line for controlling a self-test of the sensor, the DC voltage from the DC voltage source being superimposed on the AC line.

12. The detector as claimed in claim 1, wherein the sensor is a CO sensor for fire detection.

13. The detector as claimed in claim 1, wherein the sensor property is a date code of that sensor.

14. A detector system comprising:
a central control; and
a plurality of detectors, each of the plurality of detectors comprising:
a detector base;
a sensor;
first and second resistors connected in series;
a DC voltage source connected to the resistors; and
monitoring circuit for monitoring voltage at a midpoint of a potential divider, the monitoring circuit comprising the series-connected resistors,
wherein the first and second resistors are rated so that the midpoint voltage is indicative of a property of the sensor.

15. The detector system as claimed in claim 14, wherein the central control comprises software for interrogating each of the detectors to request the monitoring circuit of each detector to return to the central control a signal indicative of said property of the sensor of that detector.

16. The detector system as claimed in claim 14, further comprising a hand-held device provided with means for interrogating each of the detectors to request the monitoring circuit of each detector to emit a signal indicative of said property of the sensor of that detector.

17. The detector system as claimed in claim 16, wherein the arrangement is such that the signal emitted by each of the detectors is returned to the central control and/or the hand-held device.

18. A monitoring system comprising:

a monitoring station; and a plurality of detector systems, the plurality of detector systems communicating with the monitoring station, the detector systems comprising:

a central control; and a plurality of detectors, each of the plurality of detectors comprising:

a detector base;

a sensor;

first and second resistors connected in series;

a DC voltage source connected to the resistors; and monitoring circuit for monitoring voltage at a mid-point of a potential divider, the monitoring circuit comprising the series-connected resistors, wherein the first and second resistors are rated so that the midpoint voltage is indicative of a property of the sensor.

* * * * *